United States Patent [19]

Meyer, Jr.

[11] Patent Number: 4,866,420

[45] Date of Patent: Sep. 12, 1989

[54] METHOD OF DETECTING A FIRE OF OPEN UNCONTROLLED FLAMES

[75] Inventor: Robert H. Meyer, Jr., Pleasant Hill, Calif.

[73] Assignee: Systron Donner Corp., Concord, Calif.

[21] Appl. No.: 186,155

[22] Filed: Apr. 26, 1988

[51] Int. Cl.[4] ..... G08B 17/12

[52] U.S. Cl. ..... 340/578; 250/340; 250/554; 340/587

[58] Field of Search ..... 340/578, 587; 250/339, 250/554, 340

[56] References Cited

U.S. PATENT DOCUMENTS

| | | | |
|---|---|---|---|
| 4,533,834 | 8/1985 | McCormack | 250/554 |
| 4,553,031 | 11/1985 | Cholin et al. | 250/339 |
| 4,639,598 | 1/1987 | Kern et al. | 250/339 |
| 4,665,390 | 5/1987 | Kern et al. | 340/587 |
| 4,691,196 | 9/1987 | Kern et al. | 340/578 |
| 4,701,624 | 10/1987 | Kern et al. | 250/554 |
| 4,785,292 | 11/1988 | Kern et al. | 340/578 |

*Primary Examiner*—Glen R. Swann, III
*Assistant Examiner*—Thomas J. Mullen, Jr.
*Attorney, Agent, or Firm*—Flehr, Hohbach, Test, Albritton & Herbert

[57] ABSTRACT

A method of detecting fires utilizing its flicker frequency spectrum provides a standard theoretical flicker frequency spectrum which is compared to the real time spectrum over a 2 second time period. The comparison includes whether or not the real time fire spectrum deviates from the idealized fire spectrum by a minimum amount and has further discrimination against false fire signals, including the extent of time of the real time spectrum is outside a predetermined window and a limit on maximum deviations.

11 Claims, 4 Drawing Sheets

METHOD OF DETECTING A FIRE OF OPEN UNCONTROLLED FLAMES

The present invention is directed to a method for detecting a fire of open uncontrolled flame and more specifically, to a method utilizing a fire's flicker frequency spectrum.

BACKGROUND OF THE INVENTION

In a research project for the Naval Research Laboratory (NRL), in a report entitled "Fire Flicker Measurement Program," dated Dec. 24, 1985, Contract No. N0014-84-C-2262, David Sawyer first disclosed that open uncontrolled fires have a generalized flicker frequency spectrum where magnitudes of flicker-free frequencies are very high toward 0 Hz and then there is a steady decreasing trend. The foregoing was a theoretical analysis and no actual fire detection system was proposed.

In general, for a fire detection system it must inherently sense real fires and discriminate against false alarms of, for example, man-made origins such as various incandescent lights and blow torches; at the same time, because of the necessity of immediately extinguishing a real fire, long processing times for the information cannot be tolerated. But with shorter processing times, the information may inherently be less reliable and thus present systems have not solved these two opposing requirements.

OBJECTS AND SUMMARY OF THE INVENTION

It is therefore a general object of the present invention to provide an improved method of detecting a fire of open uncontrolled flames.

In accordance with the above object, there is provided a method of detecting a fire of open uncontrolled flames having a spectrum of flicker frequencies, which are the modulations of radiation of particular wavelengths of the fire, the flicker frequencies being in the range of substantially D.C. to 7Hz where a photodiode detector is responsive to the flicker spectrum to produce an output signal. The method comprises the following steps of determining a theoretical spectrum in the form of a curve of frequencies versus related amplitudes representing an idealized theoretical fire.

Next the detector signal is sampled over a sufficient time period to provide flicker frequency data from substantially 1 Hz, which satisfies a minimum Nyquist criteria rate with a sampling rate to provide higher flicker frequencies, to provide a real time spectrum of the fire.

Finally, criteria are selected which are referenced to the curve which consist of at least (a) a limit of deviation of the real time fire from the idealized fire and (b) a discrimination against false fire signals.

DETAILED DESCRIPTION OF PREFERRED EMBODIMENT

The system of ignition of an open flame can produce steady flicker radiation frequencies, but from a practical standpoint, since the open flame is influenced by fuel, air, temperature and density variations caused by the flame as well as external air currents, such flicker frequencies are not steady state. Rather, a large open flame will have flicker frequencies which are the result of many systems, all interferring constructively and destructively with each other. Theoretically, the flicker frequencies of radiation from a flame are produced by the vortex of air currents surrounding a flame front. Excesses in fuel and oxygen and the unique cycle of their mixing create this flicker system of ignition in an open flame.

Figure 3:
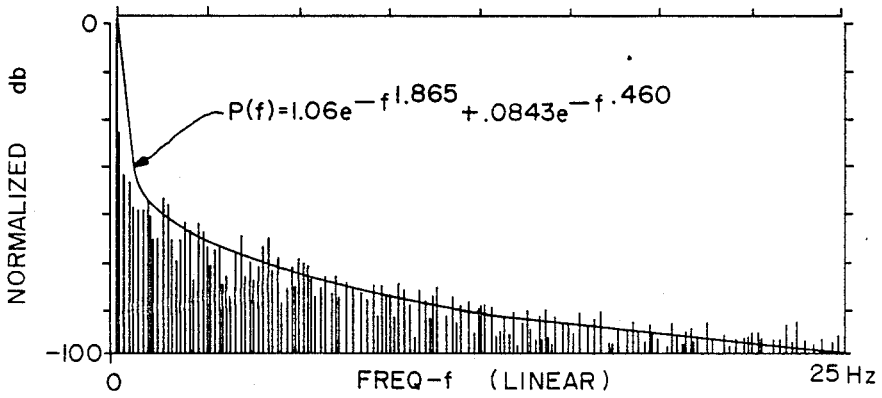
FIG. 3 is a characteristic curve utilized in the present invention.

The spectrum of flicker frequencies of an idealized open flame type fire is illustrated in FIG. 3. The specific mathematical function which substantially matches the data is shown in the drawing and designated P(f). It is generally a double exponential curve. And the curve has been normalized to a scale of 0 to −100 db from D.C. to 25 Hz for the convenience of analysis and later comparison with actual fire data. This curve was arrived at by independently collecting data from many idealized open flame fires and then averaging and compiling the data. The curve is somewhat similar in general trend to the NRL curve discussed above but was arrived at through independent experimentation. The NRL algorithm for P(f) is similar except the first term had an exponent of 0.865 rather than 1.865. In general, referring to this spectrum of the curve of FIG. 3 which represents an idealized flicker frequency spectrum of an idealized fire, the spectrum is in effect a continuous band of flicker frequencies primarily in the D.C. to 7 Hz band. Above this band or frequency, the signal is greatly attenuated.

Figure 1:
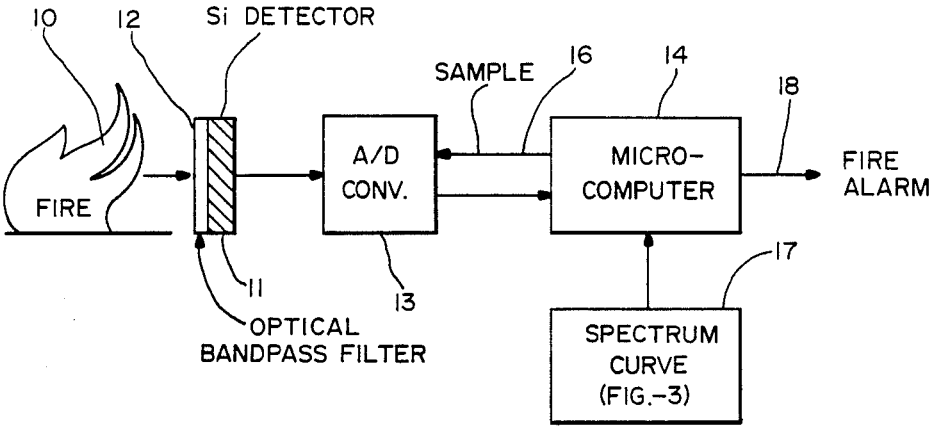
FIG. 1 is a block diagram illustrating the method of the present invention.

FIG. 1 illustrates a detection system for practicing the method of the present invention to detect an open flame fire illustrated at 10. It includes a silicon photodiode detector 11, with its input optically filtered by a bandpass filter 12, the resulting signal being converted to digital format by A to D converter 13. Then a microcomputer 14 samples this signal as determined by the sample line 16 to provide a real time spectrum of the fire 10. This is then compared to the spectrum curve of FIG. 3, as indicated in block 17 and if certain criteria are met, a fire alarm is produced on the output line 18.

Figure 2:
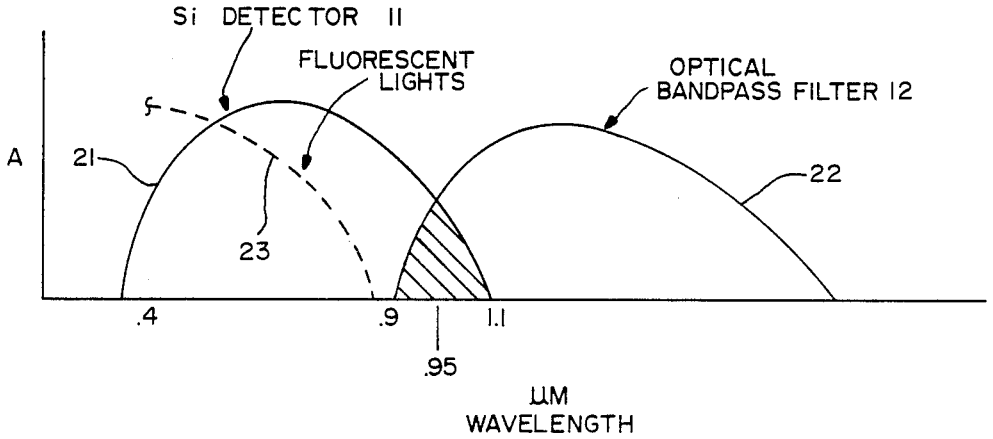
FIG. 2 are characteristic curves showing the optical response of a detector utilized in the present invention.

FIG. 2 illustrates the optical response of the silicon detector 11 and optical bandpass filter 12. The detector is a low cost, fast response silicon photodiode with a spectral range of from 0.4 to 1.1 micrometers, as indicated by silicon detector curve 21. Such silicon photodiodes are capable of nanosecond response times and have high sensitivity. In addition to response in the infrared spectrum, it is also responsive to a wide range of visible light sources which can mask or imitate fire source.

The wavelength to which detector 11 is responsive is determined by its characteristic curve 21 and the curve of optical bandpass filter 12 designated 22. Thus, the detector filter response is centered at 0.95 micrometers. This is in the infrared range and helps to avoid false alarm frequencies in other ranges. For example, the fluorescent lights indicated by the curve 23 are filtered out. Thus, the centering of the radiation detection wavelength of the detector means at 0.95 micrometers is believed to be ideal.

Referring back to the idealized theoretical curve of FIG. 3, the curve was actually constructed with the use of the above photodiode detector and with a relatively high sampling rate with many points of data being taken.

Figure 4A:
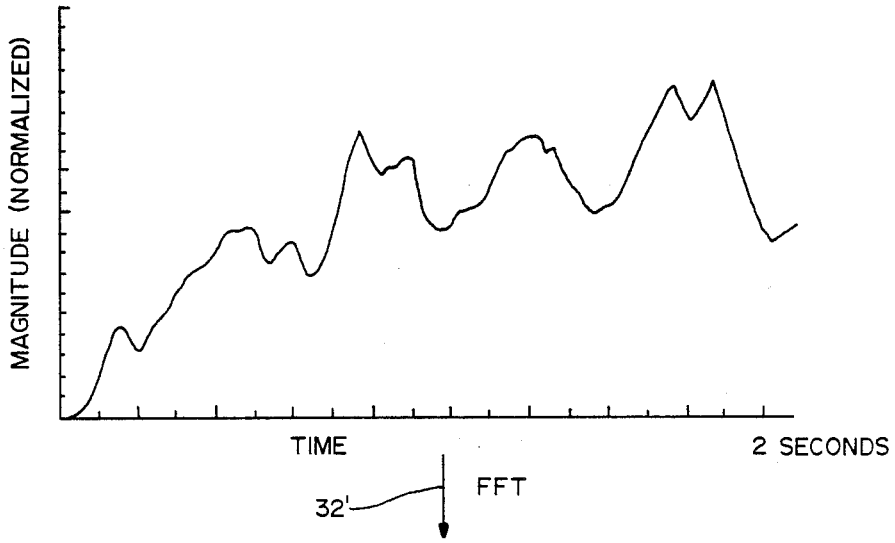
FIGS. 4A and 4B are curves showing a typical fire detected by the method of the present invention and illustrating the method.

The following method utilizing the curve of FIG. 3 and the circuit of FIG. 1 was done on a fire created by gasoline in an open pan and data was collected from the fire over a period of two seconds, as shown by the curve of FIG. 4A. Then, by fast Fourier transform, FFT (as provided by microcomputer 14), the curve of FIG. 4A was transformed to the curve of FIG. 4B which is designated 30, which is in the frequency domain rather than the time domain of FIG. 4A. The curve of FIG. 4A was obtained by a sampling rate of fifty samples per second over two seconds to provide a spectral response of D.C. to 25 Hz. Naturally, in accordance with the Nyquist rate in order to sense a frequency as low as 1 Hz, the sampling period should be at least 2 seconds. Similarly, for 25 Hz, the sampling rate should be double that frequency. Finally, from a practical standpoint, the sampling was done in four segments with 64 samples per segment to provide a resolution down to 0.8 Hz. However, the sampling rate, etc., is merely limited by the associated sampling apparatus and is not critical. The extended spectral response out to 25 Hz is necessary because flames have no spectral components in the 25 Hz region, and thus, it's possible to discriminate against false alarms since signals occurring in this region will be false alarms. Therefore, a 0 to 25 Hz bandwidth is believed ideal.

Figure 4B:
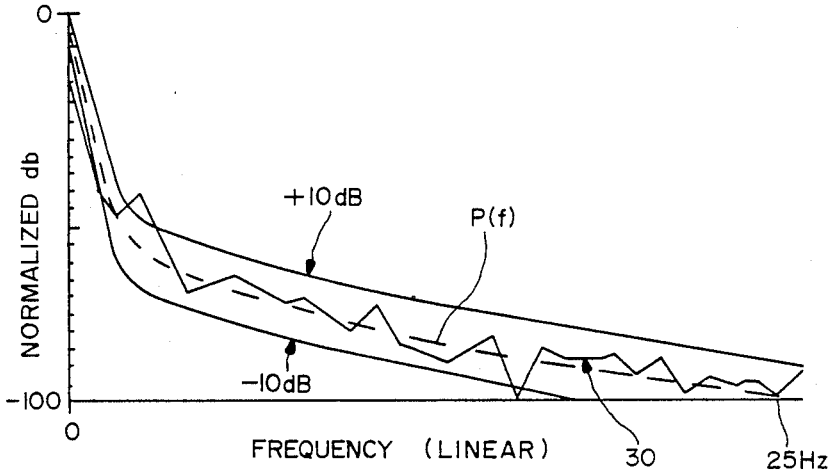

Continuing to refer to FIG. 4B, the transformed real time fire curve 30 is then compared to the idealized curve P(f) which has been normalized, as discussed above. Plus-minus 10 dB offsets are determined from the curve 30 to form a 20 dB window. Then, the preselected criteria are utilized to determine whether the real time spectrum 30 represents a real fire or a false fire.

Figure 6:
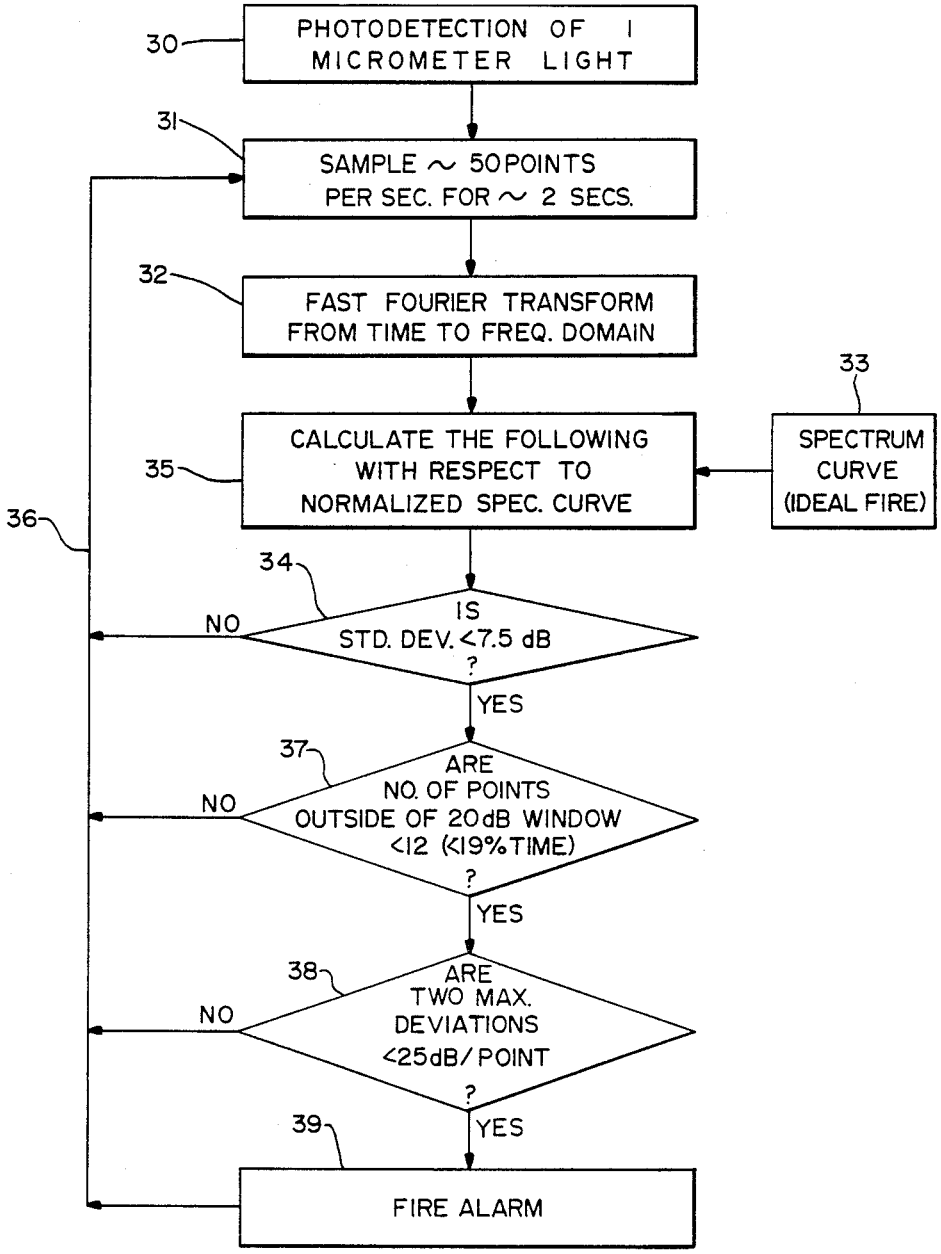
FIG. 6 is a flow chart illustrating the method of the present invention.

FIG. 6 shows the method steps which are implemented by microcomputer 14. Step 31 is the sampling of the fire by the detector 11 and microcomputer 14 where, for example, 50 points per second are taken over a 2 second interval because of the above stated reasons. In step 32 the Fast Fourier Transform (FFT) is made from the time domain of FIG. 4A to the frequency domain of FIG. 4B, as indicated by the arrow 32' in those figures.

Next, the spectrum curve 30 P(f), shown in block 33, is compared or overlaid on the real fire spectrum 30 and the following determinations or limits checked: in step 34 the question is asked is the standard deviation less than the predetermined amount and specifically 7.5 dB?. This criterion checks to see whether the real time spectrum generally conforms to the trend of a real fire. If it does not conform to the standard, then it is rejected as shown by the 'No' and return made via line 36. Then, steps 37 and 38 are two tests or limits to determine whether or not false alarm indications are present. In step 37 the question is asked are the number of points or portions of the curve outside of a 20 dB window less than 19% of the 25 Hz bandwidth?. This 20 dB window is provided as shown in FIG. 4B. Because of the specific points taken in the preferred embodiment the 19% of the bandwidth of the curve relates to 12 points out of 64. This would be the practical way of implementing the algorithm.

This criterion has its basis in that in an open fire the trend is continuous and there are no extremes. However, the criterion cannot be too strictly enforced (as discussed above), since the flicker frequency of generation is in itself somewhat unpredictable. Thus, the 19% criterion is believed to be ideal. In addition, the same is true of the 20 dB window. If this window is too large, false alarms would not be effectively excluded.

Next, as illustrated in step 38, another limit is two maximum deviations, each less than a 25 dB deviation. The reason for this is that false fire signals generally will have greater extremes than a real fire. The use of two maximum deviations may be increased up to four. But after that point the standard deviation of the curve under step 34 will actually increase above 7.5 dB to make the false alarm limitation of step 38 meaningless.

Lastly, still referring to FIG. 6, if all three limits (34, 37 and 38) are answered 'yes,' then a true fire alarm is declared. It is obvious that if any of the limits are not applicable then it is declared a false alarm. Summarizing the step 34 which is a limit of deviation assures that the fire is nominally a true fire; then steps 37 and 38 positively sense false alarms.

Figure 5A:
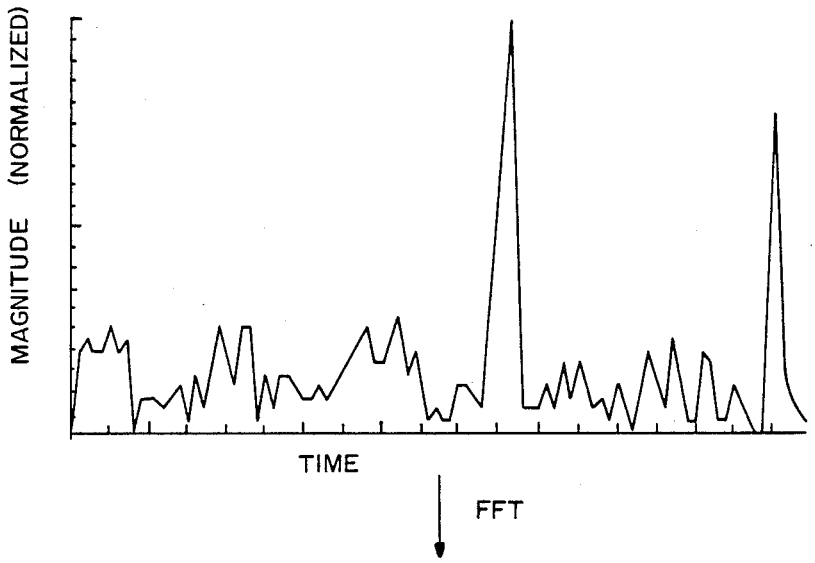
FIGS. 5A and 5B are curves showing a typical false alarm source.
Figure 5B:
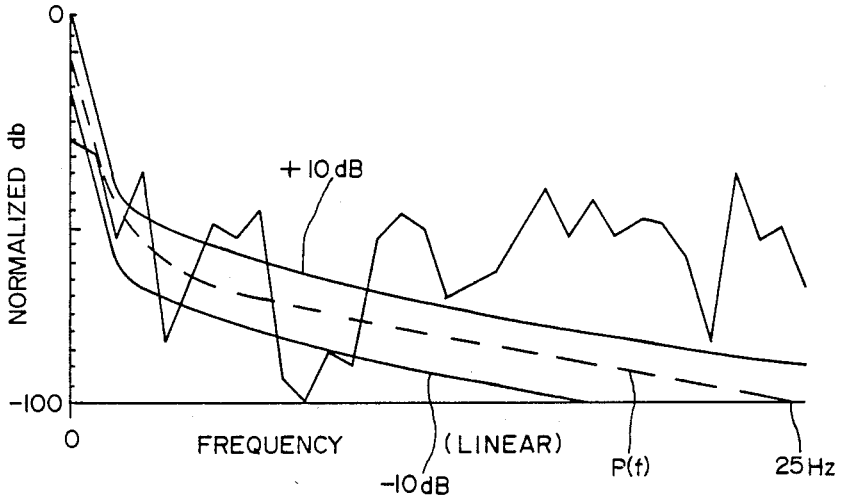

And of course, more specifically step 34 and the limitation on the standard deviation discriminates against false alarms in that many common false alarm sources have regular harmonics (for example, chopping motors in 60 Hz incandescent bulbs). These create significant deviations not common to flames. Secondly, background false alarm sources such as created by a person walking by a light source rarely produce the smooth spectral distribution seen in flames. Thus, FIG. 5B illustrates such a chopped source which shows at the higher frequencies an unusual frequency distribution. Thus, this chopped light source of FIG. 5B would fail the limit test, both on the basis that the standard deviation is greater than 7.5 dB and also the other limits that a significant number of points are outside of the 20 dB window and there are many maximum deviations greater than 25 dB.

Another factor in sensing fires is that the rise time of a fire may range from 100–300 milliseconds. This must be accommodated in making a frequency spectrum measurement in that the time domain must be greater than the frequency domain. Thus the two second time accommodates this rise time.

In summary, an improved fire detection system has been provided. The new system is believed to effectively discriminate against false alarms, such as blow torches, artificial human induced sources, machine sources, strong DC sources, but at the same time reliably senses fires ranging from propane flames to wood fires with various wind conditions involved.

What is claimed:

1. A method of detecting a fire of open uncontrolled flames having a spectrum of flicker frequencies, which are the modulations of radiation of particular wavelengths of said fire, said flicker frequencies being in the range of substantially D.C. to 7 Hz where a photodiode detector is responsive to said flicker spectrum to produce an output signal, comprising the following steps:

determining a theoretical said spectrum in the form of a double exponential curve of frequencies and related amplitudes, said curve representing an idealized theoretical said fire;

sampling said detector signal over a sufficient time period to provide flicker frequency data from substantially one Hz, which satisfies a minimum Nyquist rate and with a sampling rate to provide higher flicker frequencies to provide a real time spectrum of said fire;

and selecting criteria referenced to said curve which consist of at least (a) a limit of deviation of said real time fire from said idealized fire and (b) a discrimination against false fire signals.

2. A method as in claim 1 where said criterion "a)" is a standard deviation from said curve by said real time spectrum of less than a predetermined decibel amount.

3. A method as in claim 2 where said decibel amount is 7.5.

4. A method as in claim 1 where said curve has a predetermined bandwidth and said criterion "b)" includes (1) is the real time spectrum outside of a 20 dB window less than substantially 19% of said bandwidth?

(2) are at least two maximum deviations each less than 25 dB?

5. A method as in claim 4 where said number of maximum deviations in step 2 is four.

6. A method as in claim 1 where said time period is no more than 2 seconds.

7. A method as in claim 1 where the radiation detection wavelength of said detector means is centered at 0.95 uM.

8. A method as in claim 1 where the radiation wavelength spectrum of said detector means lies within the infrared spectrum.

9. A method as in claim 1 where said curve is normalized for a maximum at 0 Hz and a minimum at substantially 25 Hz.

10. A method as in claim 1 where said time period is greater than a rise time of said fire.

11. A method of detecting a fire of open uncontrolled flames having a spectrum of flicker frequencies, which are the modulations of radiation of particular wavelengths of said fire, said flicker frequencies being in the range of substantially D.C. to 7 Hz where a photodiode detector is responsive to said flicker spectrum to produce an output signal, comprising the following steps:

determining a theoretical said spectrum in the form of a curve of frequencies and related amplitudes, said curve representing an idealized theoretical said fire;

sampling said detector signal over a sufficient time period to provide flicker frequency data from substantially one Hz, which satisfies a minimum Nyquist rate and with a sampling rate to provide higher flicker frequencies to provide a real time spectrum of said fire;

and selecting criteria referenced to said curve which consist of at least (a) a limit of deviation of said real time fire from said idealized fire of a standard deviation of less than 7.5 decibels and (b) a discrimination against false fire signals.

* * * * *